US010612863B2

(12) United States Patent
Lin et al.

(10) Patent No.: US 10,612,863 B2
(45) Date of Patent: Apr. 7, 2020

(54) PRESSING METHOD OF HEAT CONDUCTIVE BASE AND FINISHED PRODUCT THEREOF

(71) Applicant: CHAUN-CHOUNG TECHNOLOGY CORP., New Taipei (TW)

(72) Inventors: I-Yung Lin, New Taipei (TW); Shih-Chun Sun, New Taipei (TW)

(73) Assignee: CHAUN-CHOUNG TECHNOLOGY CORP., New Taipei (TW)

( * ) Notice: Subject to any disclaimer, the term of this patent is extended or adjusted under 35 U.S.C. 154(b) by 37 days.

(21) Appl. No.: 15/972,191

(22) Filed: May 6, 2018

(65) Prior Publication Data

US 2019/0339019 A1 Nov. 7, 2019

(51) Int. Cl.
*F28D 15/02* (2006.01)
*B21K 23/00* (2006.01)

(52) U.S. Cl.
CPC ..... *F28D 15/0275* (2013.01); *B21K 23/00* (2013.01); *F28D 15/0233* (2013.01); *F28F 2255/16* (2013.01); *F28F 2275/12* (2013.01)

(58) Field of Classification Search
CPC . F28D 15/0275; F28D 15/0233; B21K 23/00; F28F 2255/16; F28F 2275/12
See application file for complete search history.

(56) References Cited

U.S. PATENT DOCUMENTS 5,638,715 A * 6/1997 Lipinski ..... F28F 3/02 29/890.03
2013/0264043 A1* 10/2013 Huang ..... H01L 23/3672 165/185

* cited by examiner

*Primary Examiner* — Rick K Chang
(74) *Attorney, Agent, or Firm* — Chun-Ming Shih; HDLS IPR Services

(57) ABSTRACT

A pressing method and a finished product thereof are provided. The pressing method includes the steps of: providing a heat conductive base (1), and defining a pressed zone (10) on the heat conductive base (1); forming a plurality of penetrated holes (100) arranged with intervals in the pressed zone (10), and forming a pressed part (101) between any two of the adjacent penetrated holes (100); and processing a pressing and extruding operation to the pressed part (101) for allowing the pressed part (101) to be pressed and extruded so as to be extended and deformed towards the adjacent penetrated hole (100) for filling the penetrated hole (100).

6 Claims, 5 Drawing Sheets

PRESSING METHOD OF HEAT CONDUCTIVE BASE AND FINISHED PRODUCT THEREOF

BACKGROUND OF THE INVENTION

Field of the Invention

The present invention relates to a heat dissipater and a manufacturing procedure thereof, especially to a pressing method of heat conductive base and a finished product thereof.

Description of Related Art

For matching the thinner design of an electronic product, a heat dissipater has to be thinned for working with the above-mentioned thinned electronic product. However, a heat conductive plate and a heat pipe disposed in a conventional heat dissipater are formed with a curtain thickness, and a pressing means is adopted for allowing a metal piece or a pipe member to be partially thinned; if a partially-thinned metal piece is desired to be formed, a conventional processing means, for example a planning, CNC (computer numerical control), etching or forging means, can be provided. The above-mentioned means has shortages of poor yield rate, high production cost and instability, and the processing result is very limited, for example the thickness of the partially-thinned area cannot be thinner than one third of the main body. If a multi-piece tin soldering procedure is desired to be separated, the subsequent process of tin soldering would be more complicated, the product cost is therefore increased, and the single piece is replaced by multiple pieces, the thinned work piece cannot be processed with a hardening operation, so that the final result is not as good as a pressing means.

As such, the yield rate and the production cost of the convention pressing forming means are better than the above-mentioned means, the hardness can be enhanced through being pressed and extended, and the material in the partially-thinned zone is also provided with a greater hardness. However, in the conventional pressing forming means, the stress applied in the pressing and extruding zone is not even, and the deformation of the thinned plate cannot be easily controlled.

Accordingly, the applicant of the present invention has devoted himself for improving the mentioned disadvantages.

SUMMARY OF THE INVENTION

The present invention is to provide a pressing method of heat conductive base and a finished product thereof, the deforming direction and the deforming degree of a plate piece while being pressed can be more easily controlled, a force applied to the plate piece can be more even and a greater hardness can be provided under a situation of being thinned.

Accordingly, the present invention provides a pressing method of heat conductive base, including the steps of:

a) providing a heat conductive base, and defining a pressed zone on the heat conductive base;

b) forming a plurality of penetrated holes arranged with intervals in the pressed zone, and forming a pressed part between any two of the adjacent penetrated holes; and c) processing a pressing and extruding operation to the pressed part for allowing the pressed part to be pressed and extruded so as to be extended and deformed towards the adjacent penetrated hole for filling the penetrated hole.

Accordingly, the present invention provides a heat conductive base, which comprises a thin plate part and two wing parts at two sides of the thin plate part, wherein thicknesses of the two wing parts are both thicker than a thickness of the thin plate part, and a plurality of engaged slits are formed in the thin plate part.

Accordingly, the present invention provides a heat dissipater, which comprises an above-mentioned heat conducive base and a heat pipe, wherein the heat pipe and the thin plate part are in a thermal contacting status.

DETAILED DESCRIPTION OF THE INVENTION

A preferred embodiment of the present invention will be described with reference to the drawings.

Figure 1:
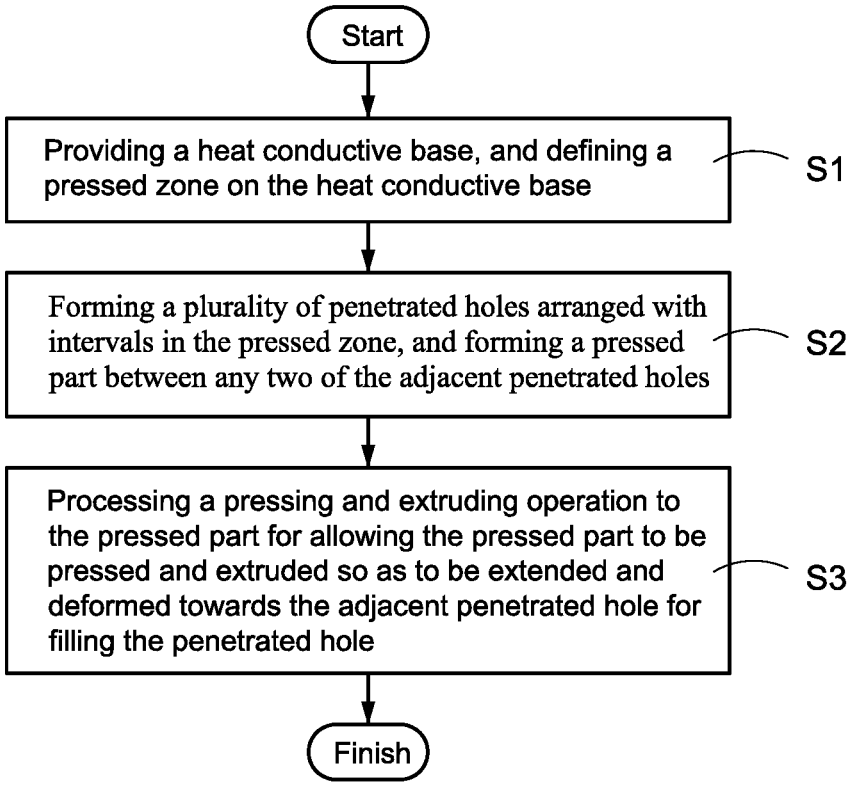
FIG. 1 is a flowchart showing a punching method according to the present invention.
Figure 2:
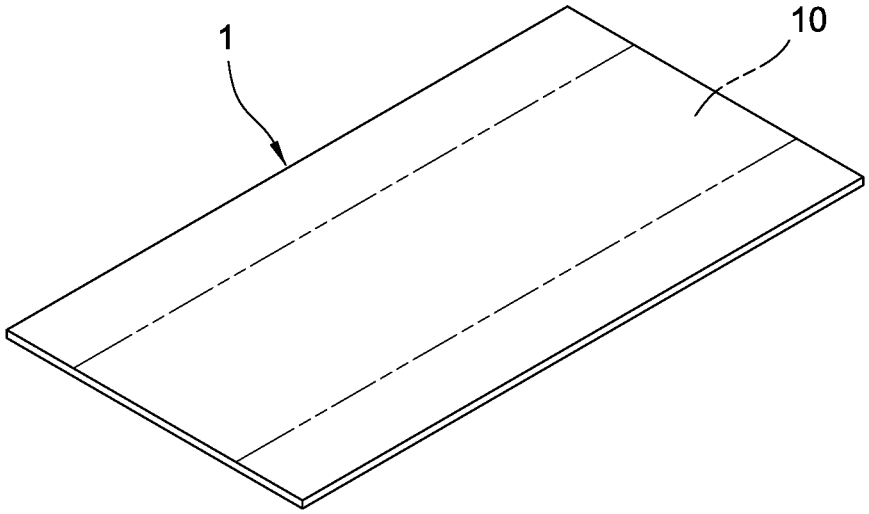
FIG. 2 is a perspective view showing a heat conductive base before being formed according to the present invention.
Figure 8:
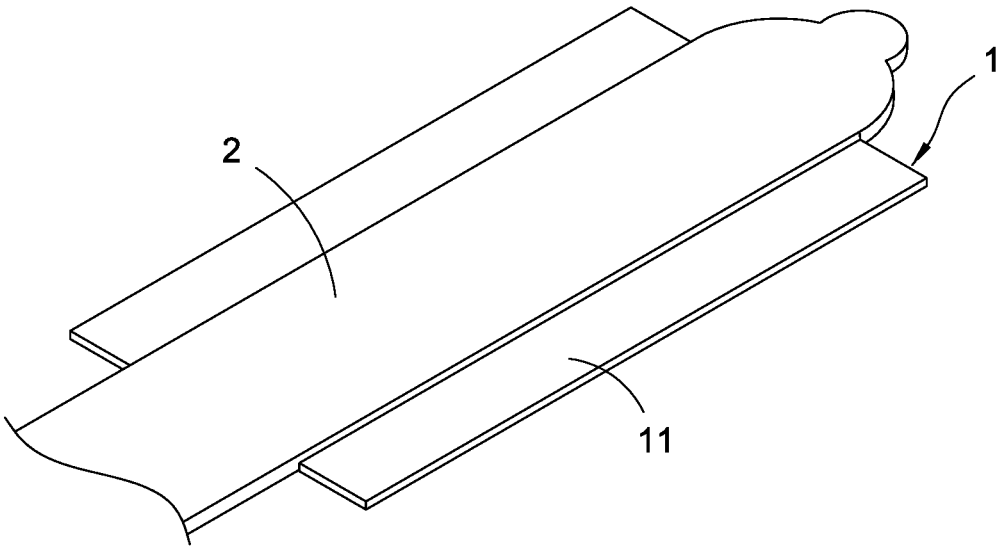
FIG. 8 is a partial perspective view showing the heat conductive base being combine with a heat pipe according to the present invention.
Figure 9:
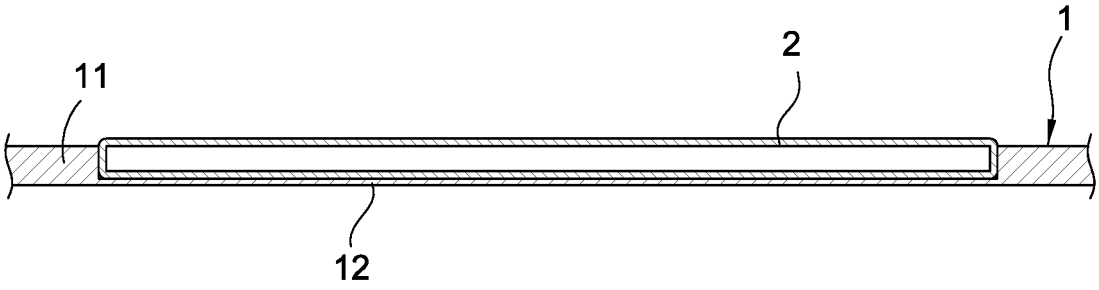
FIG. 9 is a plane cross sectional view showing the heat conductive base being combine with the heat pipe according to the present invention.

Please refer from FIG. 1 and FIG. 2, wherein FIG. 1 is a flowchart showing a punching method according to the present invention; and FIG. 2 is a perspective view showing a heat conductive base before being formed according to the present invention. The present invention provides a pressing method of heat conductive base and a finished product thereof. As shown in a S1 of FIG. 1 and FIG. 2: firstly, a heat conductive base 1 is provided, the heat conductive base 1 can be made of a metal material for example aluminum or copper, and can formed in a thin plate status, and a pressed zone 10 is predefined on the heat conductive base 1, the pressed zone 10 is a portion of the heat conductive base 1 which is processed with a pressing and extruding operation for being thinned, and the pressed zone 10 can be used for being arranged to be adjacent to a thinned heat pipe 2 (as shown in FIG. 8 or FIG. 9), or the heat pipe 2 can be partially embedded in the pressed zone 10 for being in a thermal contacting status.

Figure 3:
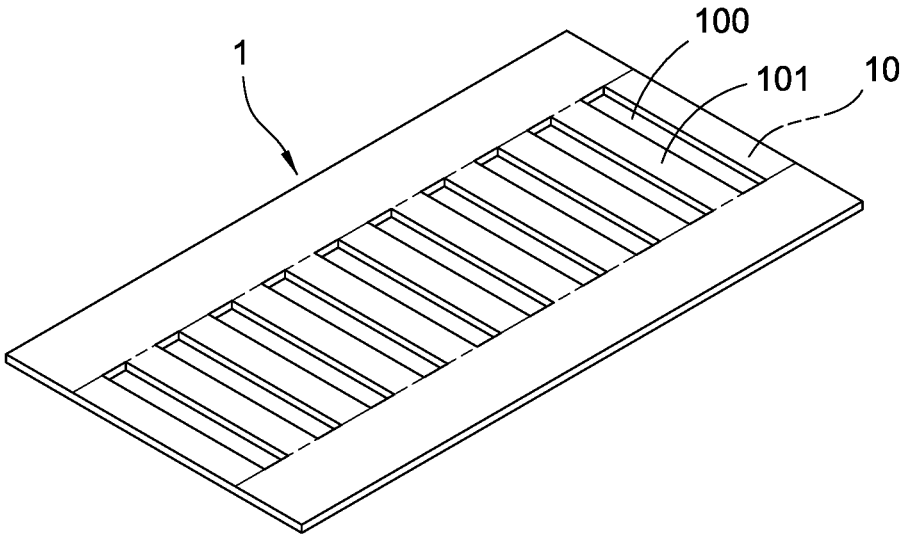
FIG. 3 is a perspective view showing the heat conductive base being formed with penetrated holes according to the present invention.

As shown in a S2 of FIG. 1 and FIG. 3: the pressed zone 10 is formed with a plurality of penetrated holes 100 arranged with intervals, and a pressed part 101 is formed between every two of the adjacent penetrated holes 100; according this embodiment provided by the present invention, the penetrated holes 100 are extended and arranged with intervals along a length direction of the pressed zone 10, so that the pressed zone 10 can be pressed and extruded for forming as an elongated recess, and the penetrated hole 100 can be formed as the pressed part 101 after being processed with a material punching operation for removing residual materials.

Figure 4:
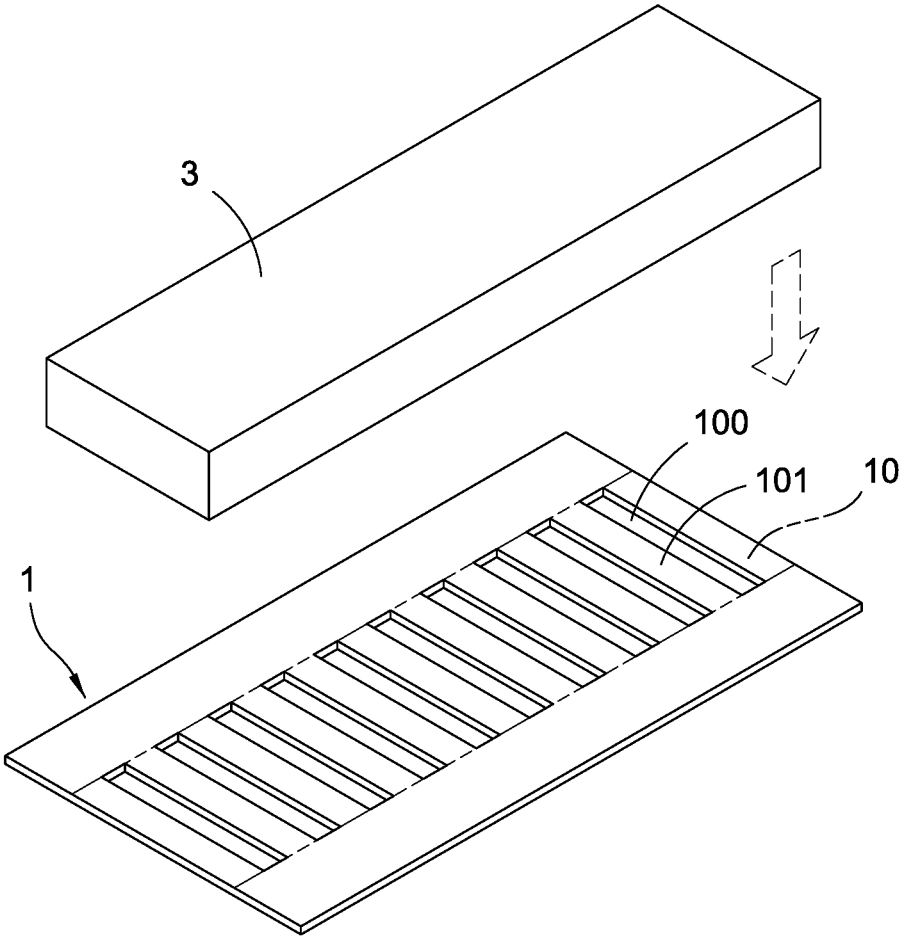
FIG. 4 is a perspective view showing the heat conductive base being processed with a pressing and extruding operation according to the present invention.
Figure 5:
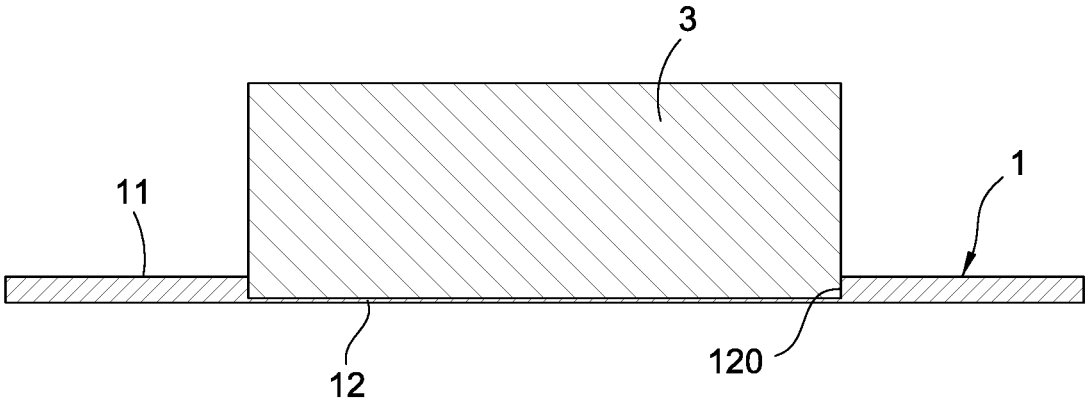
FIG. 5 is a plane cross sectional view showing the heat conductive base being processed with the pressing and extruding operation according to the present invention.
Figure 6:
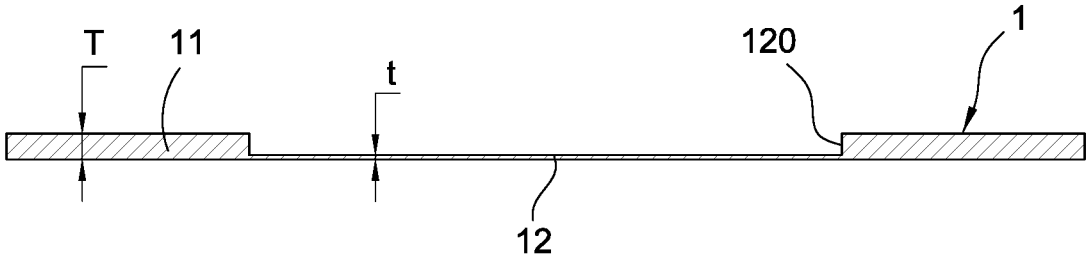
FIG. 6 is a plane cross sectional view showing the heat conductive base after the pressing and extruding operation being finished according to the present invention.

Lastly, as shown in a S3 and FIG. 4 and FIG. 5, the pressed part 101 is processed with a pressing and extruding operation for allowing the pressed part 101 to be pressed and extruded so as to be extended and deformed towards the adjacent penetrated hole 100, and the penetrated hole 100 is filled through the pressed part 101 being extended and deformed; according to this embodiment provided by the present invention, the pressed zone 10 is processed with the pressing and extruding operation by utilizing a pressing and extruding mold 3, so that a thickness t of the pressed zone 10 is pressed and extruded for being smaller than an original thickness T of the heat conductive base 1. Please refer to FIG. 6, a thin plate part 12 is formed after the pressed zone 10 is processed with the pressing and extruding operation, and a concave groove 120 is formed on the heat conductive base 1; the thin plate part 12 is formed through the pressed parts 101 being pressed and extruded for being deformed so as to be connected with each other, and a plurality of engaged slits 121 are formed on the thin plate part 12, in other words the engaged slits 121 are formed through the pressed parts 101 being extended and deformed for filling the penetrated holes 100 and abutting against each other. Meanwhile, because the pressed zone 10 has already been pressed and extruded for forming as the thin plate part 12, the heat conductive base 1 is formed with wing parts 11 at two sides of the thin plate part 12 and having the thickness T being thicker than the thickness t of the thin plate part 12.

Figure 7:
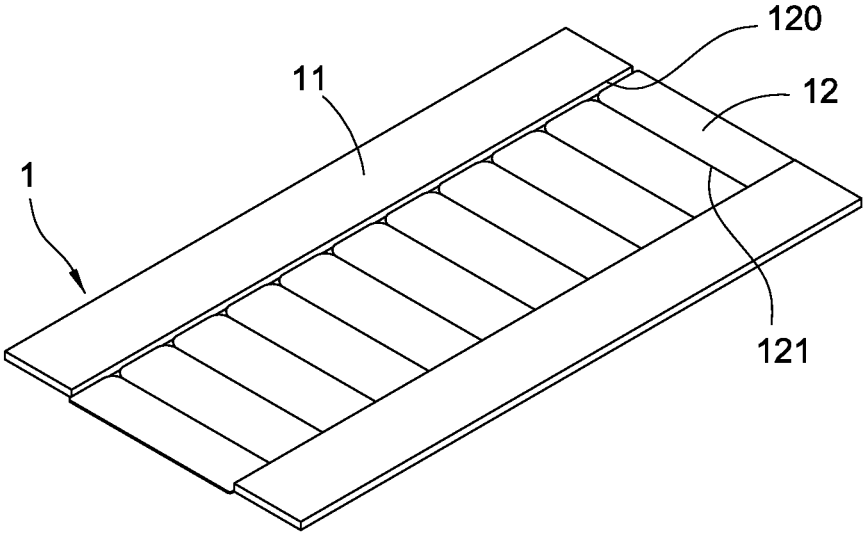
FIG. 7 is a perspective view showing the heat conductive base after the pressing and extruding operation being finished according to the present invention.

Please refer to FIG. 7, the pressed part 101 of the pressed zone 10 is pressed and extruded for being extended and deformed, the outmost pressed part 101 is also extended which generates protruding residual material, a grinding or a cutting operation can be processed for removing the residual material so as to be flattened. Lastly, please refer to FIG. 8 and FIG. 9, the thinned heat pipe 2 is allowed to be adjacently disposed on the pressed zone 10, or the heat pipe 2 can be partially embedded in the pressed zone 10 for being in a thermal contacting status, thereby assembling a thinned heat dissipater.

As such, with the above-mentioned components, the pressing method of heat conductive base and the finished product thereof are provided.

Accordingly, with the pressing method of heat conductive base and the finished product thereof provided by the present invention, the deforming direction and the deforming degree of a plate piece while being pressed can be more easily controlled through the plural penetrated holes 100 arranged with intervals, meanwhile a force applied to the plate piece can be more even and a greater hardness can be provided under a situation of being thinned.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A pressing method of heat conductive base, including the steps of:

a) providing a heat conductive base, and defining a pressed zone and wing parts on the heat conductive base;

b) forming a plurality of penetrated holes arranged with intervals in the pressed zone (10), and forming a pressed part between every two of the adjacent penetrated holes; and c) processing a pressing and extruding operation to the pressed part for allowing the pressed part to be pressed and extruded to form an extension part extending towards the adjacent penetrated hole until any two adjacent extension parts contact each other for fully filling the penetrated hole, such that a thickness of the pressed zone is thinner than a thickness of the wing parts.

2. The pressing method of heat conductive base according to claim 1, wherein the heat conductive base is made of a metal material such as aluminum or copper.

3. The pressing method of heat conductive base according to claim 1, wherein in the step b), the penetrated holes are extended and arranged with intervals along a length direction of the pressed zone.

4. The pressing method of heat conductive base according to claim 1, wherein in the step b), the penetrated hole is formed as the pressed part after being processed with a material punching operation for removing residual material.

5. The pressing method of heat conductive base according to claim 1, wherein in the step c), the pressed zone is processed with the pressing and extruding operation by utilizing a pressing and extruding mold.

6. The pressing method of heat conductive base according to claim 1, wherein in the step c), the outmost pressed part is processed with operations of removing residual material and flattening.

* * * * *